US005641001A

United States Patent [19]

Wilson

[11] Patent Number: 5,641,001

[45] Date of Patent: Jun. 24, 1997

[54] PAPERMAKER'S FABRIC WITH ADDITIONAL CROSS MACHINE DIRECTION YARNS POSITIONED IN SADDLES

[75] Inventor: Robert G. Wilson, Wake Forest, N.C.

[73] Assignee: Huyck Licensco, Inc., Wilmington, Del.

[21] Appl. No.: 515,821

[22] Filed: Aug. 16, 1995

[51] Int. Cl.[6] ..... D03D 13/00

[52] U.S. Cl. ..... 139/383 A

[58] Field of Search ..... 139/383 A; 428/257; 162/902, 903

[56] References Cited

U.S. PATENT DOCUMENTS

| | | | |
|---|---|---|---|
| 4,499,927 | 2/1985 | Borel | 139/383 A |
| 4,739,803 | 4/1988 | Borel | 139/383 A |
| 4,776,373 | 10/1988 | Borel | 139/383 A |
| 4,784,190 | 11/1988 | Mullaney | 139/383 A |
| 4,815,503 | 3/1989 | Borel | 139/383 A |
| 4,870,998 | 10/1989 | Westhead | 139/383 A |
| 5,054,525 | 10/1991 | Vohringer | 139/383 A |
| 5,101,866 | 4/1992 | Quigley | 139/383 A |
| 5,152,326 | 10/1992 | Vohringer | 139/383 A |

*Primary Examiner*—Andy Falik

*Attorney, Agent, or Firm*—Bell, Seltzer, Park & Gibson, P.A.

[57] ABSTRACT

A papermaker's forming fabric comprising a fabric layer including cross machine direction fabric yarns and machine direction fabric yarns interwoven to form a papermaking surface with alternating single knuckles thereon and to define top, bottom, left, and right saddles between adjacent ones of the cross machine direction fabric yarns. According to one embodiment of the invention, first and second additional cross machine direction yarns are interwoven with the base fabric between adjacent cross machine direction fabric yarns and positioned oppositely in top and bottom saddles. According to another embodiment, single additional cross machine direction fabric yarns are interwoven with the base fabric between adjacent ones of the cross machine direction fabric yarns. The single additional cross machine direction yarns are positioned successively and repeatedly in right, top, left, and then top saddle positions.

11 Claims, 4 Drawing Sheets

PAPERMAKER'S FABRIC WITH ADDITIONAL CROSS MACHINE DIRECTION YARNS POSITIONED IN SADDLES

FIELD OF THE INVENTION

This invention relates to woven fabrics and especially to paper forming fabrics.

BACKGROUND OF THE INVENTION

In the conventional fourdrinier papermaking process, a water slurry, or suspension, of cellulosic fibers, known as the paper "stock", is fed onto the top of the upper run of a traveling endless belt of woven wire and/or synthetic material. The belt provides a papermaking surface and operates as a filter to separate the cellulosic fibers from the aqueous medium to form a wet paper web. In forming the paper web, the forming belt serves as a filter element to separate the aqueous medium from the cellulosic fibers by providing for the drainage of the aqueous medium through the mesh openings of the belt, known as drainage holes, by vacuum means, or the like, located on the machine side of the belt, or "fabric". After leaving the forming section, the paper web is transferred to a press section of the machine, where it is passed through a series of pressure nips formed by cooperating press rolls to remove still more of the moisture content. The paper is then transferred to a dryer section for further moisture removal.

Such papermakers' fabrics are manufactured in accordance with two basic methods to form an endless belt. They are flat woven by a flat weaving process with their ends joined by any one of a number of well known methods to form an endless belt. Alternatively, they are woven directly in the form of a continuous belt by means of an endless weaving process. In a flat woven papermakers' fabric, the warp yarns extend in the machine direction and the filling yarns extend in the cross machine direction. In a papermakers' fabric having been woven in an endless fashion, the warp yarns extend in the cross machine direction and the filling yarns extend in the machine direction. As used herein the terms "machine direction" and "cross machine direction" refer, respectively, to a direction equivalent to the direction of travel of the papermakers' fabric on the papermaking machine, and a direction traverse to the direction of travel. Both methods are well known in the art and the term "endless belt" as used herein refers to belts made by either method.

Effective sheet support and lack of wire marking are important considerations in papermaking, especially for the forming section of the papermaking machine where the wet web is formed. The problem of wire marking is particularly acute in the formation of fine paper grades where the smoothness of the sheet side surface of the forming fabric is critical. Marking affects a host of paper properties, such as sheet mark, porosity, see through, pin holing, and the like. Accordingly, paper grades intended for use in carbonizing, cigarettes, electrical condensers, quality printing, and like grades of fine paper, have heretofore been formed on very fine woven forming fabrics or fine wire mesh forming fabrics. In order to ensure good paper quality, the side of the papermakers' fabric which contacts the paper stock must provide high support for the stock, preferably in the cross machine direction, because paper fibers delivered from a headbox to the forming fabric are generally aligned in the machine direction more so than in the cross machine direction. Trapping these paper fibers on the top of the forming fabric during the drainage process is more effectively accomplished by providing a permeable structure with a co-planar surface which allows paper fibers to bridge the support grid of the fabric, rather than align with the support grid. By "co-planar" is meant that the upper extremities of all yarns defining the paper forming surface are at the same level, such that at that level there is presented a substantially "planar" surface.

Such forming fabrics, however, may often be delicate and lack stability in the machine and cross machine directions, leading to a short service life. Abrasive and adhesive wear caused by contact with the papermaking machine equipment constitutes a substantial problem. The side of the papermakers' fabric which contacts the paper machine equipment must be tough and durable. Such qualities, however, most often are not compatible with the good drainage and fiber supporting characteristics desired for the sheet side of a papermakers' fabric.

In order to meet both standards, two layers of fabric can be woven at once by utilizing threads of different size and/or count per inch and another thread to bind them together. This fabric is commonly called a double layer fabric. Alternatively, fabrics have been created using multiple layers to insure that the fabric has desirable papermaking qualities on the surface that faces the paper web and desirable wear resistance properties on the machine contacting surface. For example, papermakers' fabrics may be produced from two separate fabrics, one having the qualities desired for the paper contacting side and the other with the qualities desired for the machine contacting side, joined together by a third set of threads. This type fabric is commonly called a triple-layer fabric. Generally, these structures do not possess the high level of stretch resistance desired in a papermaking fabric. Furthermore, the yarn that binds the fabric together will often produce a sheet mark, often from the long machine direction floats. Accordingly, no known fabrics have achieved the qualities necessary to meet the competing standards to produce superior paper.

OBJECTS OF THE INVENTION

It is, therefore, an object of the present invention to provide a papermakers' fabric with a superior fiber supporting surface, while maintaining a durable wear resistant machine contacting side of the fabric.

Another object of the present invention is to provide a papermakers' fabric which has a significant number of the paper fiber supporting yarns yet the openness of the paper contacting surface remains high for effective drainage.

A further object of the present invention is to provide a papermakers' fabric having a predominance of cross machine direction support floats on the papermaking surface, with no machine direction yarn knuckle being greater than a single float.

Yet another object of the present invention is to provide a papermakers' fabric with excellent stability and wear resistance while not compromising the desirable papermaking characteristics of the sheet side of the fabric.

SUMMARY OF THE INVENTION

With the above and other objects in view, as will hereinafter appear, a feature of the present invention is the provision of a papermaker's forming fabric comprising a base fabric layer of cross machine direction fabric yarns and machine direction fabric yarns interwoven to form a papermaking surface. The machine direction fabric yarns form single float machine direction knuckles on adjacent ones of the cross machine direction fabric yarns to define top, bottom, left, and right saddles between adjacent cross machine direction fabric yarns.

In one embodiment, first and second additional cross machine direction yarns are interwoven with the papermaking surface between adjacent cross machine direction fabric yarns. The first and second yarns additional cross machine direction yarns are positioned oppositely in the top and bottom saddles so that when the first additional yarn is in a top saddle, the second additional yarn is in a bottom saddle. Preferably, the additional yarns are also positioned alternately in the top and bottom saddles.

The fabric layer according to invention can be incorporated into any fabric structure, be it a double layer, triple layer, or triple weft fabric as long as single knuckle machine direction floats are formed on the papermaking surface. Preferably, however, the base fabric layer forms a first layer of a seven harness double layer fabric. Also, in the preferred embodiment, each of the machine direction base fabric yarns step four adjacent cross machine direction base fabric yarns before repeating the weave pattern of a preceding adjacent machine direction base fabric yarn.

In a second embodiment, single additional cross machine direction yarns are interwoven with the papermaking surface between adjacent cross machine direction fabric yarns and positioned consecutively in a right saddle, then in a first top saddle, then in a left saddle, and then in a second top saddle. This results in the single additional yarns forming a zig-zag pattern between adjacent cross machine direction fabric yarns. Again, as in the first embodiment, the fabric layer of the second embodiment may form part of any base fabric structure. However, it is preferred that the fabric layer be the first layer of a seven harness double layer fabric wherein the machine direction yarns step four adjacent cross machine direction yarns before repeating the weave of the preceding machine direction yarn.

BRIEF DESCRIPTION OF THE DRAWING

Reference is made to the accompanying Figures in which are shown illustrative embodiments of the invention, and from which its novel features and advantages will be apparent. In the Drawing.

DETAILED DESCRIPTION OF THE INVENTION

The fabric of the present invention will be described broadly, with a more detailed description following. This papermakers' fabric provides a superior papermaking surface and is especially suitable for the forming section of a papermaking machine. The fabric,of the present invention is characterized by the presence of additional cross machine direction yarns positioned in saddles created by the machine direction yarns of the base fabric. By positioning the additional cross machine direction yarns within these saddles, a co-planar paper contacting surface with a significant number of cross machine direction fiber supporting yarns is achieved.

The fabric of the present invention is a papermakers' fabric with a particular weave. For ease of understanding the concepts of the invention, the fabric will be described as if a fabric layer were initially woven and then additional yarns added. Of course, the papermakers' fabric made according to the present invention will be woven in a one step weaving process, as is commonly done.

The yarns utilized in the fabric of the present invention will vary, depending upon the desired properties of the final papermakers' fabric. For example, the yarns may be multifilament yarns, monofilament yarns, twisted multifilament or monofilament yarns, spun yarns, or any combination thereof. It is within the skill of those practicing in the relevant art to select a yarn type, depending on the purpose of the desired fabric, to utilize the concepts of the present invention.

Likewise, the material of the yarns selected for use in the fabric of the present invention may be those commonly used in papermakers' fabric. The yarns may be cotton, wool, polypropylenes, polyesters, aramids, nylon, or the like. Again, one skilled in the relevant art will select a yarn material according to the particular application of the final fabric. A commonly used yarn which can be used to great advantage in weaving fabrics in accordance with the present invention is a polyester monofilament yarn, sold by Hoechst Celanese Fiber Industries under the trademark "Trevira".

Figure 1:
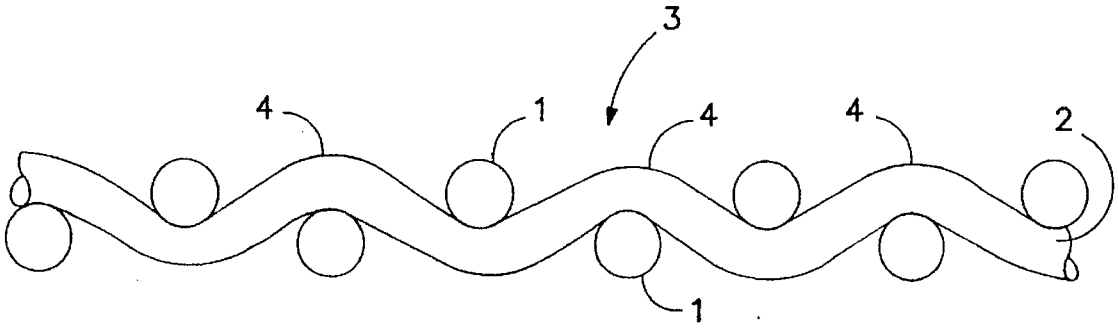
PRIOR ART FIG. 1
FIG. 1: is a sectional view of a portion of a prior art papermaking fabric layer showing single knuckle machine direction floats.

Referring now to FIG. 1, an important feature of the present invention is shown from a sectional view of a prior art plain-weave base fabric. According to the present invention, cross machine direction base fabric yarns 1 are interwoven with machine direction base fabric yarns 2 to form a base fabric layer structure 3. This layer may be a single layer fabric or form part of multiple layer fabric, and may be woven in a number of different weave patters. The fabric must, however, have on its paper contacting surface single float machine direction knuckles 4. As shown in FIG. 1, by "single float machine direction knuckles" it is meant that no machine direction yarn 2 ever passes over more than one consecutive cross machine direction yarn 1 before passing back down into the center or bottom of the fabric layer. Instead of long machine direction yarn floats on the paper contacting surface of the fabric layer, single float knuckles 4 are provided to minimize the influence of the machine direction yarns on the support of the forming paper mat.

Figure 2:
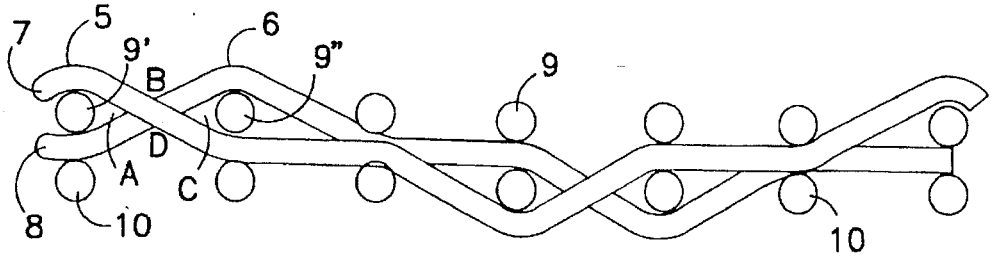
FIG. 2: is a sectional view of one embodiment of a base fabric structure according to the present invention showing saddle positions.

Turning to FIG. 2, a further important feature of the present invention will now be apparent. For ease of understanding, FIG. 2 shows only two 7,8 of many base fabric machine direction yarns interwoven with cross machine direction base fabric yarns 9,10. According to the invention, single float machine direction knuckles 5,6 are formed on adjacent cross machine direction base fabric yarns 9', 9" by machine direction base fabric yarns 7,8. The opposing slopes of the machine direction base fabric yarns 7,8 thus define cross machine direction saddles at points A,B,C,D within the base fabric structure. As can be seen, a left saddle A, a top saddle B, a right saddle C, and a bottom saddle D is associated with each pair of single float machine direction knuckles 5,6 formed on adjacent cross machine direction fabric yarns 9', 9".

Figure 3:
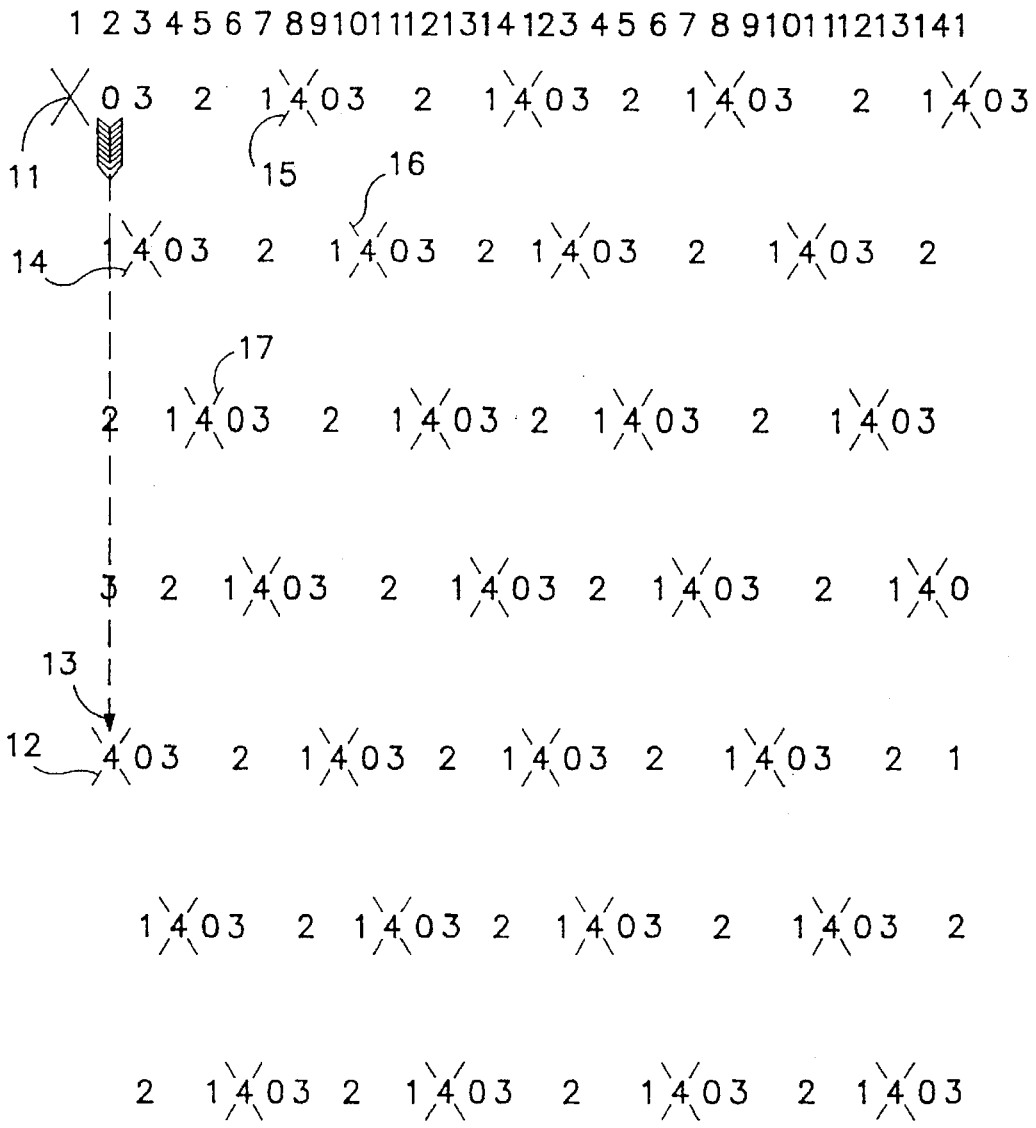
FIG. 3: is diagrammatic view of preferred base fabric paper contacting surface according to the present invention.

Importantly, it is not necessary that the saddles are formed by adjacent machine direction base fabric yarns. In fact, a preferred base fabric structure, as shown in FIG. 3, is a 7 harness double layer base fabric with each successive base fabric machine direction yarn being stepped four cross machine direction yarns. Referring to FIG. 3, the repeating numbers 1-2-3-4-5-6-7-8-9-10-11-12-13-14 across the top denote successive or adjacent base fabric machine direction yarns while the recurring numbers 0-1-2-3-4 denote adjacent base fabric cross machine direction yarns relative to single float machine direction knuckles designated X.

The knuckle 11 below the left-most machine direction yarn designated 1 represents the first single float machine direction yarn knuckle. Since the base fabric machine direction yarn knuckles are stepped by four base fabric cross machine direction yarns, the next successive base fabric yarn (at position 2) is woven to form a single float machine direction yarn knuckle 12 on the fourth successive adjacent cross machine direction yarn shown as position 4 at the end of arrow 13. Each successive base fabric machine direction yarn continues in this manner to create a single float knuckle on the fourth successive adjacent base fabric cross machine direction yarn as shown. With this weave, a set of saddle positions (A,B,C,D in FIG. 2) is defined between pairs of single float machine direction knuckles on adjacent cross machine direction yarns, e.g between knuckles 11 and 14, 15 and 16, 14 and 17, etc.

Figure 4:
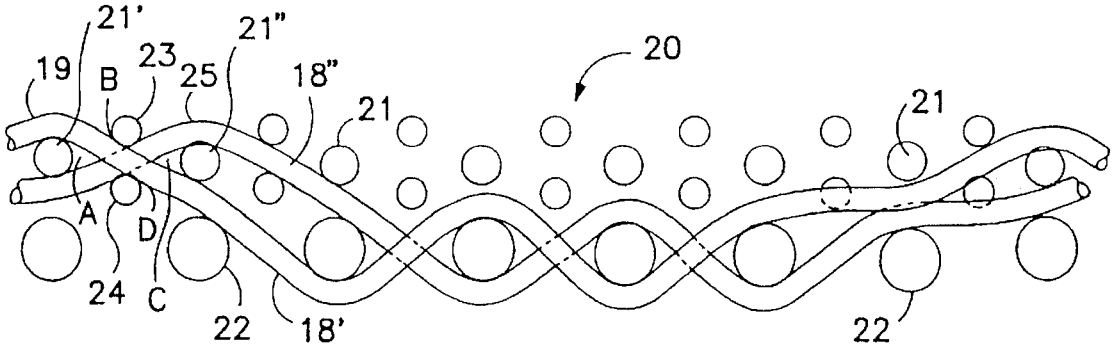
FIG. 4: is a sectional view of a preferred embodiment of a papermakers' fabric according to the present invention having first and second additional cross machine direction yarns positioned oppositely in top and bottom saddles.

Turning now to FIG. 4, a first preferred embodiment of the present invention is shown which utilizes the saddles of the base fabric weave. For ease of understanding, FIG. 4 shows only two base fabric, machine direction yarns 18', 18" of seven in a 7 harness double layer base fabric 20 interwoven with cross machine direction yarns 21,22 to form saddles A,B,C,D. As can be seen, machine direction yarn 18' is woven to provide a single float knuckle 19 on cross machine direction yarn 21', and machine direction yarn 18" is interwoven to form a single float knuckle 25 on the next adjacent cross machine direction yarn 21". The interposing slopes of the machine direction yarns 18', 18" thus form the saddle positions A,B,C,D, between adjacent base fabric cross machine direction yarns 21', 21".

Interwoven with the base fabric cross machine direction yarns 21,22 and the base fabric machine direction yarns 18', 18" are two additional cross machine direction yarns, first additional cross machine direction yarns 23 and second additional cross machine direction yarns 24. As shown also in FIG. 5, the first 23 and second 24 additional cross machine direction yarns are woven into the paper contacting surface of the fabric layer in a weave pattern generally opposite to each other. Thus, the first additional cross machine direction yarns 23 are in a top saddle position B while the second additional cross machine direction yarns 24 are in a bottom saddle position C as in FIG. 4. This relationship reverses at the next cross machine direction repeat of the weave pattern, i.e. the first additional cross machine direction yarn 23 is in a bottom saddle position D while the second additional cross machine direction yarn 24 is in a top saddle position B. This reversing of saddle positions by the two additional cross machine direction yarns continues across the fabric width with each additional cross machine direction yarn acting as a fiber supporting yarn which is co-planar with the papermaking surface.

Figure 5:
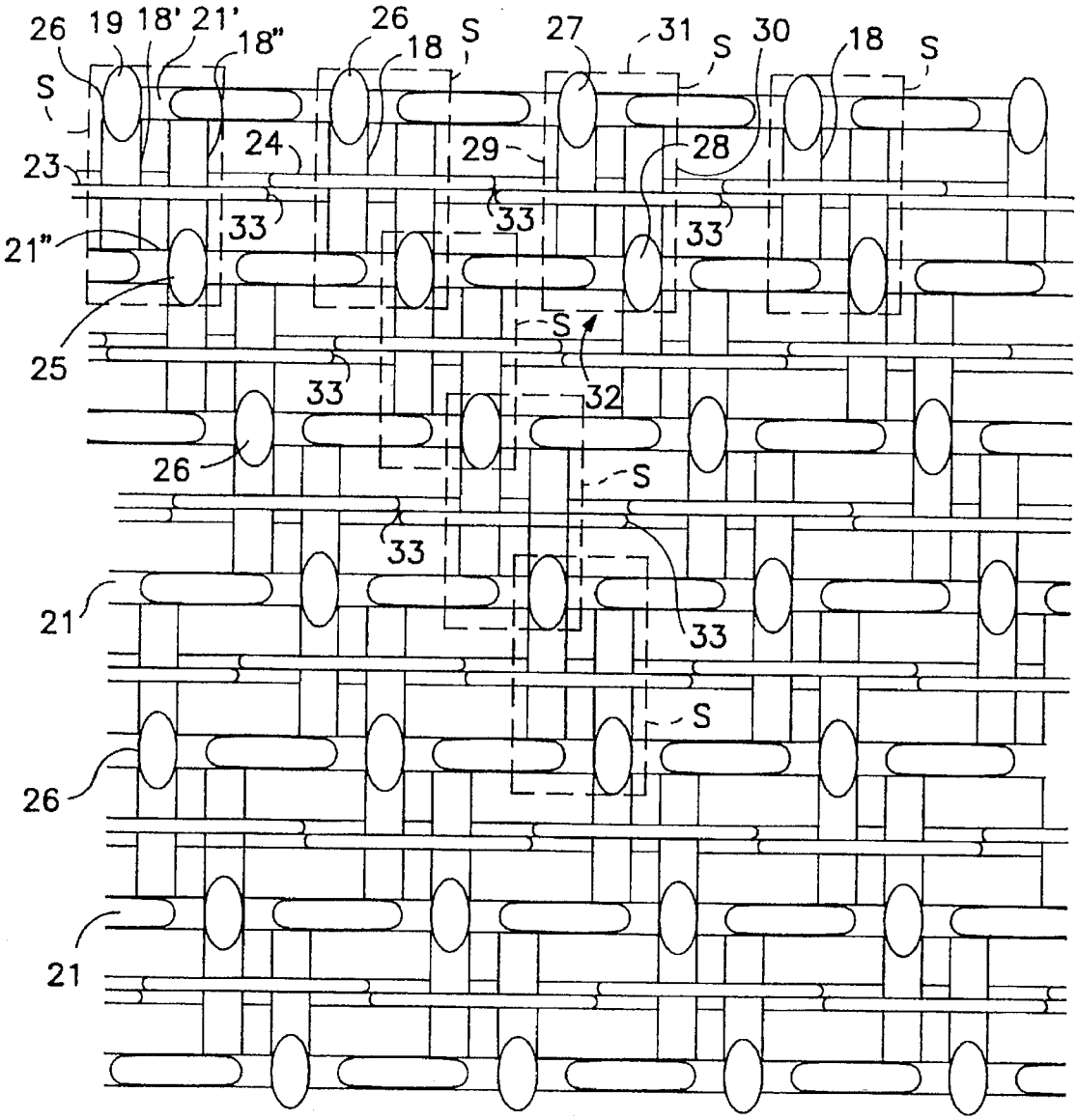
FIG. 5: is a top plan view, in part diagrammatic, of the papermaking surface of the fabric depicted in FIG. 4.

Referring to FIG. 5, the papermaking surface of the fabric of FIG. 4 is shown. Again, the base fabric is a 7-harness fabric with each successive machine direction yarn 18 being stepped four successive cross machine direction yarns 21 in the manner shown in FIG. 3. As can be seen, the intersections of the base fabric yarns 18,21 create single float machine direction knuckles illustrated diagrammatically by ovals 26. The long axis of each oval 26 indicates the direction of the upper-most yarn passing over the lower-most yarn, when viewed from above the uppermost level of the forming fabric.

From these single float machine direction knuckles 26, saddle regions designated generally at S can be located. The borders of each saddle region are defined by the single float machine direction knuckles 26 on adjacent cross machine direction yarns. For example, referring to the knuckles designated as 27 and 28, two sidles 29,30 of the saddle region S associated with knuckles 27,28 are parallel to the machine direction yarns 18 and adjacent the sides of the single float knuckles 27,28. The two ends 31,32 of the saddle region S are parallel to the base fabric cross machine direction yarns 21 and adjacent the ends of the single float knuckles 27,28.

From these saddle regions S, an important aspect of the present invention is apparent in connection with the crossing points 33 of the additional cross machine direction yarns 23,24. The "crossing points" 33 of the first additional yarns 23 and the second additional yarns 24 are defined as the points where the two yarns cross each other and interchange saddle positions. According to the present invention, these crossing points 33 must be located outside of the saddle regions S. With this arrangement, the first and second additional cross machine direction yarns are always firmly positioned within a top or bottom saddle. Accordingly, the first and second additional cross machine direction yarns are forced into a central position between adjacent base fabric cross machine direction yarns 21 by the interposing slopes of the machine direction yarns 18 which form the saddles thereby forming a coplanar paper contacting surface.

Figure 6:
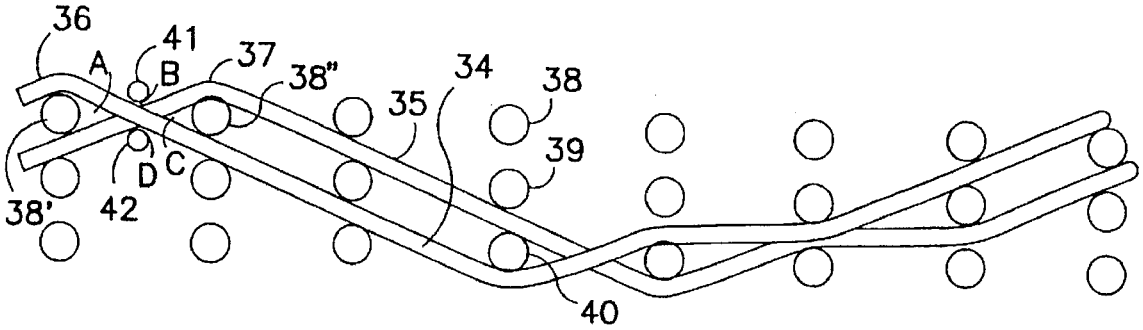
FIG. 6: is a sectional view of a fabric according to the present invention using a triple weft base fabric.

Although the embodiment of FIGS. 4 and 5 has been shown in connection with a 7-harness double layer fabric structure, the present invention may be achieved in any base fabric weave having single float machine direction knuckles on consecutive base fabric cross machine direction yarns due to the creation of the saddles. For example, in FIG. 6, there is shown a triple weft base fabric structure showing only two of many base fabric machine direction yarns 34,35 for simplicity. As is known, a triple weft base fabric contains three base fabric cross machine direction layers corresponding to cross machine direction yarns 38,39,40, respectively. Single float machine direction knuckles 36,37 may be formed on adjacent base fabric cross machine direction yarns 38',38" thereby creating saddle positions A,B,C,D into which additional cross machine direction yarns 41,42 may be positioned as described in connection with FIGS. 4 and 5.

Figure 7:
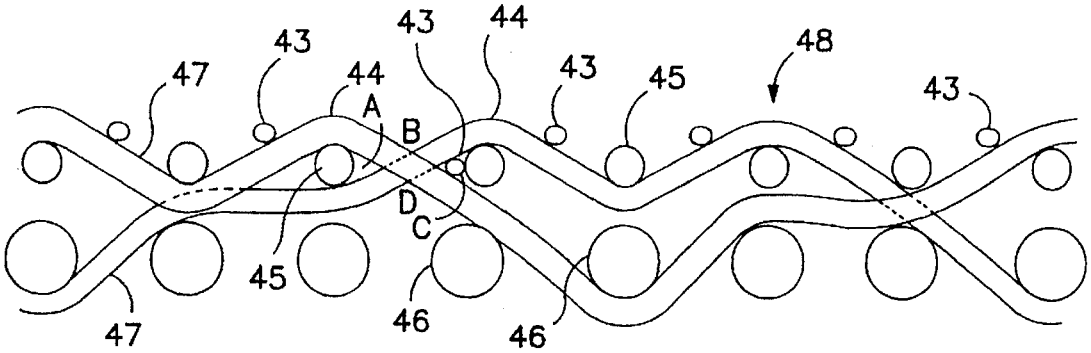
FIG. 7: is a sectional view of a another preferred embodiment of a papermakers' fabric according to the present invention having single additional cross machine direction yarns.
Figure 8:
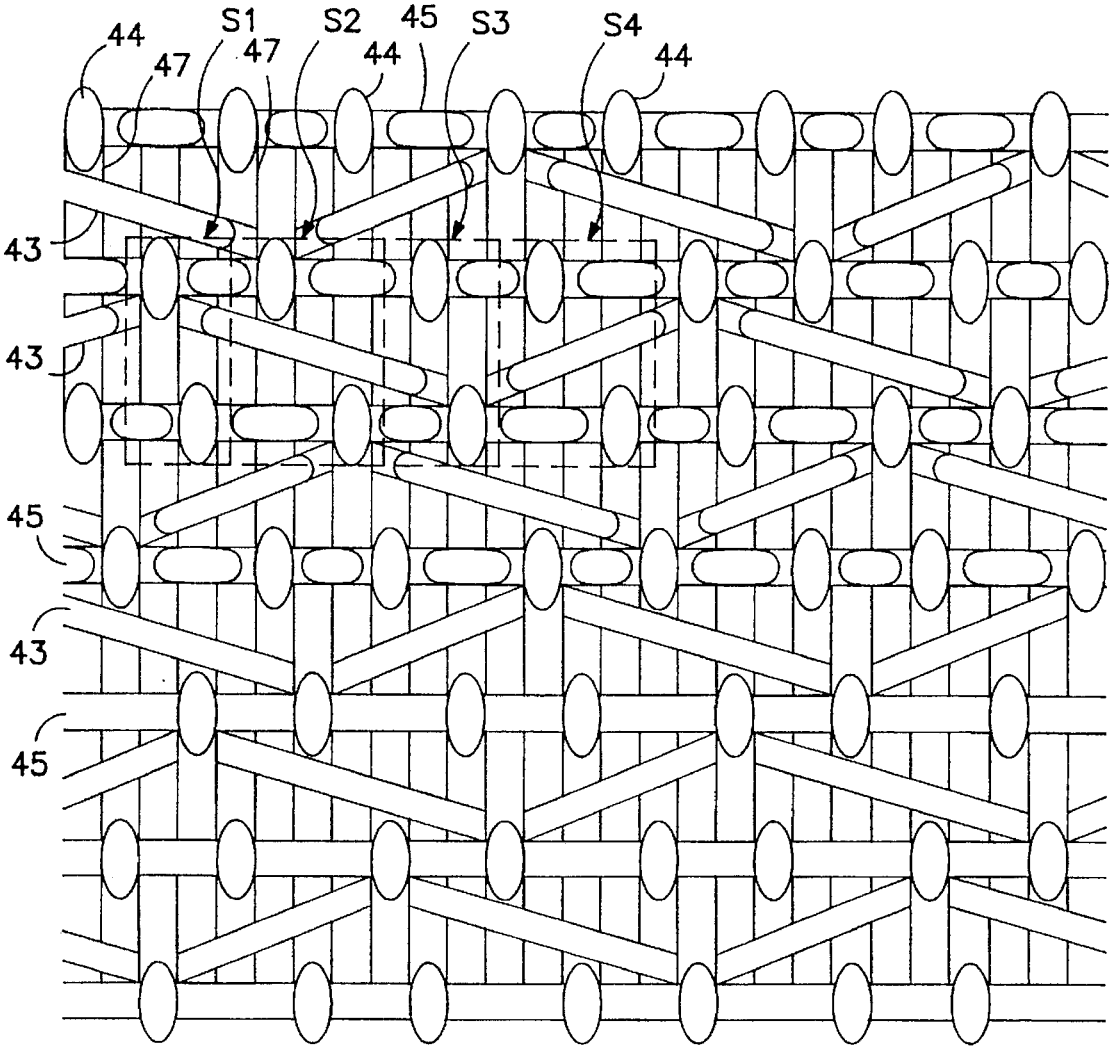
FIG. 8: is a top plan view, in part diagrammatic, of the papermaking surface of the fabric depicted in FIG. 7 showing the positioning of the single additional cross machine direction yarns consecutively in right, top, left, and top saddle positions.

Turning now to FIGS. 7 and 8, a second embodiment Of the present invention is shown. Again, the base fabric 48 includes machine direction yarns 47 interwoven with cross machine direction yarns 45,46 to form single float machine direction knuckles 44 on adjacent cross machine direction base fabric yarns and saddle positions at points A,B,C, and D. Here, however, only single additional cross machine direction yarns 43 are interwoven with the base fabric structure 48 in the saddles between adjacent cross machine direction base fabric yarns 45.

As shown in FIG. 8, the single additional cross machine direction yarns 43 are interwoven to be positioned consecutively in a right saddle position (point C in FIG. 7) as in saddle region S1, a first top saddle position as in saddle region S2, a left saddle position as in saddle region S3, and then in a top saddle position again as in saddle region S4. This right-top-left-top saddle position pattern for the additional cross machine direction yarns 43 repeats across the width of the fabric as shown in FIG. 8.

As in the embodiment of FIGS. 4 and 5, the single additional cross machine direction yarns 43 of the embodiment of FIGS. 7 and 8, never change position within a saddle region. In these saddle regions, the additional cross machine direction yarn is always positioned within either a top, left, or right saddle. In this fashion, the additional cross machine direction yarns form a zig-zag pattern across the width of the fabric between adjacent base fabric cross machine direction yarns 45. Again, the papermaking surface of the fabric remains co-planar and the additional yarns operate effectively as fiber supporting yarns for the wet fiber matt.

Thus, according to the present invention there is provided a papermaker's fabric having a superior fiber supporting surface while maintaining a durable wear resistant machine contacting side. There is further provided a fabric having a predominance of cross machine direction support floats on the papermaking surface, with no machine direction yarn knuckle being greater than a single float.

It is to be understood that the present invention is by no means limited to the particular constructions herein disclosed and/or shown in the drawings, but also comprises any modifications or equivalents within the scope of the claims.

Having thus described my invention, what I claim as new and desire to secure by Letters Patent of the United States is:

1. A papermakers' forming fabric comprising:

a base fabric layer of cross machine direction fabric yarns and machine direction fabric yarns interwoven to form a papermaking surface wherein said machine direction fabric yarns form single float machine direction knuckles on adjacent ones of said cross machine direction fabric yarns, wherein portions of each of said machine direction yarns extending between knuckles on said adjacent ones of cross machine direction yarns define top and bottom saddles between said adjacent ones of said cross machine direction fabric yarns;

first additional cross machine direction yarns positioned between adjacent ones of said cross machine direction fabric yarns on said papermaking surface of said base fabric layer; and second additional cross machine direction yarns positioned between said adjacent ones of said cross machine direction fabric yarns on said papermaking surface of said base fabric layer;

wherein said first and second additional cross machine direction yarns are interwoven with said papermaking surface between said adjacent ones of said cross machine direction fabric yarns to be positioned oppositely in said top and bottom saddles, said first and second additional cross machine direction yarns crossing each other and thereby interchanging saddle positions at crossing points, said crossing points being outside of said top and bottom saddles.

2. A papermakers' fabric according to claim 1, wherein said first and second additional cross machine direction yarns are positioned alternately in said top and bottom saddles.

3. A papermakers' fabric according to claim 1, wherein said base fabric layer comprises a first fabric layer of a double layer fabric.

4. A papermakers' fabric according to claim 3, wherein said double layer fabric is a seven harness double layer fabric.

5. A papermakers' fabric according to claim 1, wherein each of said machine direction base fabric yarns step four adjacent ones of said cross machine direction base fabric yarns before repeating the weave pattern of a preceding adjacent machine direction base fabric yarn.

6. A papermakers' fabric according to claim 1, wherein said cross machine direction fabric yarns comprise a first set of cross machine direction yarns in a triple weft fabric.

7. A papermakers' forming fabric comprising:

a base fabric layer including cross machine direction fabric yarns and machine direction fabric yarns interwoven to form a papermaking surface wherein said machine direction fabric yarns form single float machine direction knuckles on adjacent ones of said cross machine direction fabric yarns, wherein portions of each of said machine direction yarns extending between knuckles on said adjacent ones of cross machine direction yarns define top, left, and right saddles between said adjacent ones of said cross machine direction fabric yarns; and single additional cross machine direction yarns positioned between adjacent ones of said cross machine direction fabric yarns on said papermaking surface of said base fabric layer, said single additional cross machine direction yarns not forming part of said base fabric layer;

wherein said single additional cross machine direction yarns are interwoven with said papermaking surface between said adjacent ones of said cross machine direction fabric yarns and are positioned consecutively in a right saddle, then in a first top saddle, then in a left saddle, and then in a second top saddle.

8. A papermakers' fabric according to claim 7, wherein said base fabric layer comprises a first fabric layer of a double layer fabric.

9. A papermakers' fabric according to claim 8, wherein said double layer fabric is a seven harness double layer fabric.

10. A papermakers' fabric according to claim 7, wherein each of said machine direction base fabric yarns step four adjacent ones of said cross machine direction base fabric yarns before repeating the weave pattern of a preceding adjacent machine direction base fabric yarn.

11. A papermakers' fabric according to claim 7, wherein said cross machine direction fabric yarns comprise a first set of cross machine direction yarns in a triple weft fabric.

* * * * *